US006942577B2

(12) United States Patent
McKevitt et al.

(10) Patent No.: US 6,942,577 B2
(45) Date of Patent: Sep. 13, 2005

(54) LIGHT UP POOL CUE

(75) Inventors: Thomas McKevitt, Warrington, PA (US); Gary D. Giegerich, North Woods, PA (US)

(73) Assignee: DMI Sports, Inc., Fort Washington, PA (US)

( * ) Notice: Subject to any disclaimer, the term of this patent is extended or adjusted under 35 U.S.C. 154(b) by 0 days.

(21) Appl. No.: 10/752,331

(22) Filed: Jan. 6, 2004

(65) Prior Publication Data

US 2004/0142755 A1 Jul. 22, 2004

Related U.S. Application Data

(60) Provisional application No. 60/441,042, filed on Jan. 17, 2003.

(51) Int. Cl.[7] ..... A63D 15/08
(52) U.S. Cl. ..... 473/44
(58) Field of Search ..... 473/2, 44–51, 473/221, 222

(56) References Cited

U.S. PATENT DOCUMENTS

| | | | | | |
|---|---|---|---|---|---|
| 4,688,796 | A | * | 8/1987 | Wright | 473/2 |
| 5,299,983 | A | * | 4/1994 | Pfost et al. | 473/45 |
| 5,554,075 | A | * | 9/1996 | Glazer | 473/2 |
| 6,117,019 | A | * | 9/2000 | Taylor | 473/46 |
| 6,155,929 | A | * | 12/2000 | Chipman | 473/2 |
| 6,165,078 | A | * | 12/2000 | Holt | 473/44 |
| 6,746,336 | B1 | * | 6/2004 | Brant et al. | 473/44 |
| 2003/0017882 | A1 | * | 1/2003 | Hossack | 473/222 |
| 2003/0104874 | A1 | * | 6/2003 | Galanis et al. | 473/221 |

* cited by examiner

*Primary Examiner*—Mark S. Graham
(74) *Attorney, Agent, or Firm*—Akin Gump Strauss Hauer & Feld, LLP

(57) ABSTRACT

A light up pool cue has control circuitry operatively coupled to a sensor and a light source. The sensor is adapted to detect impact of the pool cue with another object. Upon detection of the impact, the sensor generates an electrical signal to the control circuitry, causing the control circuitry to illuminate the light source.

14 Claims, 3 Drawing Sheets

LIGHT UP POOL CUE

CROSS-REFERENCE TO RELATED APPLICATIONS

This application claims benefit of U.S. Provisional Patent Application No. 60/441,042, "Light Up Pool Cue", filed Jan. 17, 2003.

BACKGROUND OF THE INVENTION

The present invention relates generally the game of pool, and more particularly to pool cues.

Pool cues are well known in the art. A pool cue typically is designed to accurately and comfortably perform the function of striking billiard balls. A pool cue with additional functional features would enhance the entertainment derived from the game of billiards. A need exists, therefore, for a pool cue with additional functional features.

BRIEF SUMMARY OF THE INVENTION

Briefly stated, the invention is a light up pool cue having a shaft and a handle with a butt end. The light up pool cue comprises a power source; control circuitry operatively coupled to the power source; a sensor operatively coupled to the control circuitry; and a light source operatively coupled to the control circuitry. The sensor is adapted to detect an impact of the pool cue with another object. Upon detection of the impact, the sensor generates an electrical signal to the control circuitry, causing the control circuitry to illuminate the light source.

BRIEF DESCRIPTION OF THE SEVERAL VIEWS OF THE DRAWINGS

The following detailed description of a preferred embodiment of the invention will be better understood when read in conjunction with the appended drawings. For the purpose of illustrating the invention, there are shown in the drawings an embodiment which is presently preferred. It should be understood, however, that the invention is not limited to the precise arrangements and instrumentalities shown.

In the drawings.

DETAILED DESCRIPTION OF THE INVENTION

Figure 1:
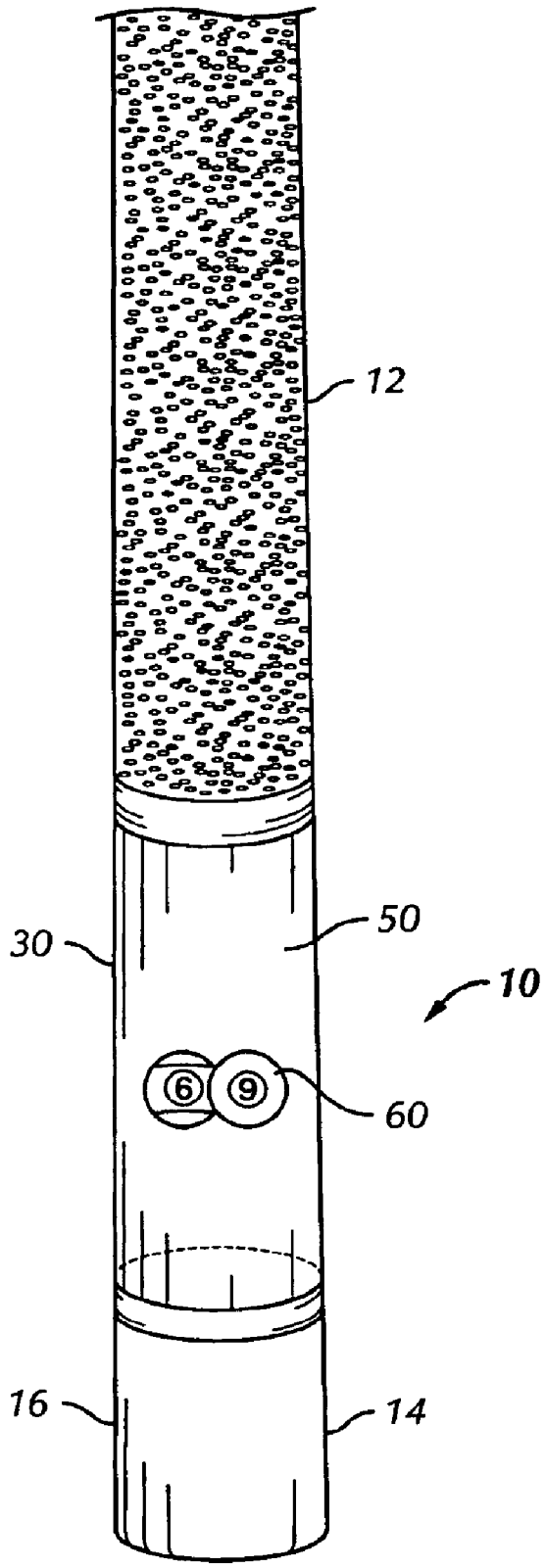
FIG. 1 is a side elevational view of a butt end of a pool cue having a lighted assembly in accordance with a preferred embodiment of the present invention.
Figure 2:
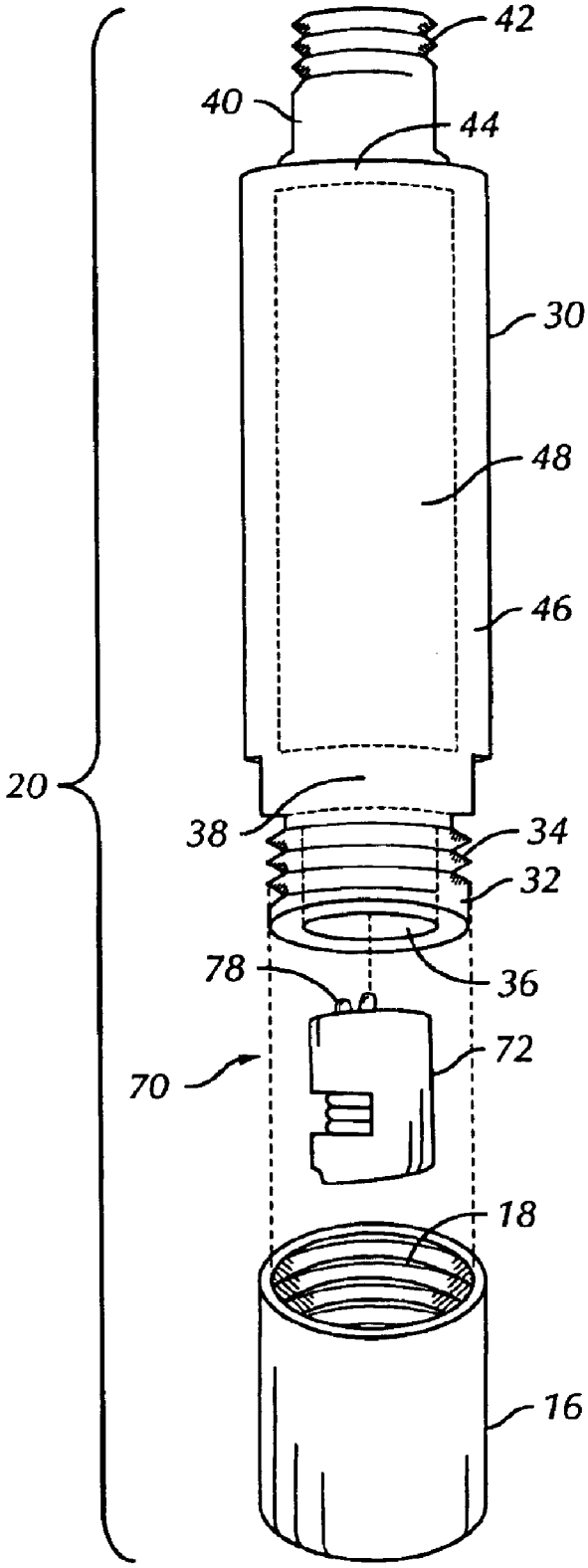
FIG. 2 is an exploded perspective view of the lighted assembly of FIG. 1.
Figure 3:
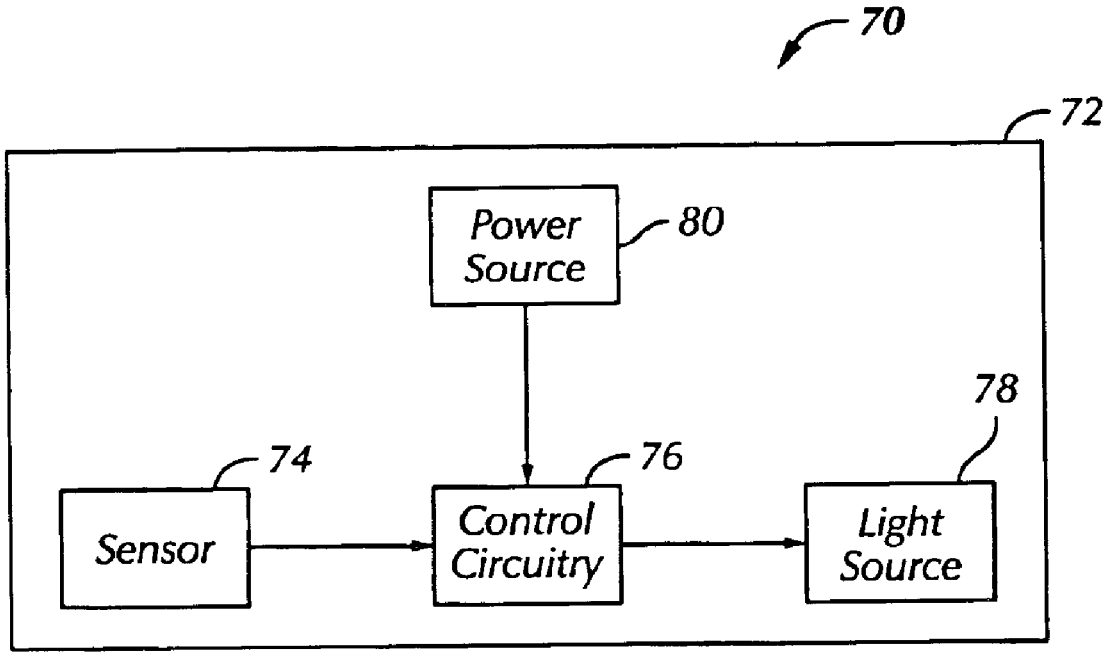
FIG. 3 is a schematic block diagram of the preferred electrical elements of the lighted assembly of FIG. 1.

Referring to the drawings, wherein like referenced numerals are used to designate the same components throughout the figures, there is shown in FIGS. 1–3 in accordance with a preferred embodiment of the present invention a pool cue 10 provided with a lighted assembly 20, including a light source 78, such as one or more light emitting diodes, which is illuminated when the pool cue 10 strikes another body, such as a billiard ball.

With reference to FIGS. 1 and 2, the pool cue 10 includes a handle 12. The pool cue 10 further includes a shaft (not shown). The shaft portion and the handle 12 are often connected by a threaded joint (not shown), but may be integral. The handle 12 terminates in a butt end 14, onto which an end cap 16 is preferably connected. The lighted assembly 20, located proximate the butt end 14, forms a portion of the handle 12 and is attached to a remainder of the handle 12.

The lighted assembly 20 includes a transparent or translucent housing member 30, having a first end 32 and a second end 40. The housing member 30 is preferably hollow, forming a sealed cavity 48. The sealed cavity 48 is bounded by cylindrical side wall 46 and by first and second end walls 38 and 44, proximate the first and second ends 32 and 40, respectively. The housing member 30 is preferably provided with first end threads 34 and second end threads 42. The housing member 30 may be connected with the remainder of the handle 12 by engagement of the second end threads 42 with mating threads (not shown) in the remainder of the handle 12. The end cap 16 may be connected to the housing member 30 by engagement of end cap threads 18 with the first end threads 34. Proximate the first end 32, the housing member 30 includes an open-ended cavity 36. The housing member 30 is preferably fabricated from a durable, resilient and transparent or translucent polymeric material such as the material sold under the trademark LEXAN®. The housing member 30 may be clear or may be color-tinted.

With reference now to FIGS. 2 and 3, the open-ended cavity 36 is sized to receive a flash unit 70. When the end cap 16 is connected to the first end 32, the flash unit 70 is secured within the open-ended cavity 36 by the end cap 16. The flash unit 70 comprises a housing member 72 containing a commercially available sensor 74 such as an impact or vibration sensor capable of detecting impact of the pool cue with an object such as a billiard ball. The flash unit 70 further comprises a power source 80 such as a battery and light source 78 such as a pair of light emitting diodes. The flash unit 70 further comprises control circuitry 76 of a well-known type for controlling the operation of the light source 78. The light source 78 may emit white light or colored light. The sensor 74 is operably connected to the light source 78 such that when the pool cue 10 experiences a sufficient impact (such as would occur when the pool cue strikes a billiard ball), the light source 78 is caused to illuminate. In one preferred mode of operation, the control circuitry 76, upon receipt of a signal from the sensor 74, causes the light source 78 to steadily emit light for a predetermined period of time (for example, 20 seconds). Alternatively the light source 78 could be controlled to blink on and off for a predetermined period of time or to illuminate in some other predetermined pattern. Light emitted by the light source 78 is visible to a user of the pool cue 10 through the housing member 30.

With reference again to FIG. 1, a fluid 50, for example glycerin, is preferably sealed within the housing member cavity 48. Preferably, the fluid is relatively viscous, for example having a viscosity at room temperature in the range of 500 to 5000 centipoise. The fluid may be transparent or may be colored. Preferably, at least one decorative element 60 is also sealed within the housing member cavity 48. Given the viscosity of the fluid 50, the decorative element 60 tends to move slowly within the housing member cavity 36 under gravitational and inertial forces.

In use, when a player strikes a billiard ball with the pool cue, the sensor 74 generates a signal to the control circuitry 76. The control circuitry 76 in turn causes the light source 78 to illuminate, creating an entertaining visual effect visible through the transparent or translucent housing member 30.

From the foregoing it can be seen that the present invention comprises a pool cue which provides an entertaining functional feature of a portion of the pool cue being illuminated when the pool cue strikes a billiard ball. It will be appreciated by those of ordinary skill in the art that modifications may be made to the above described embodiment without departing from the scope and spirit of the present invention.

We claim:

1. A light up pool cue having a shaft and a handle with a butt end, comprising:

a power source;

control circuitry operatively coupled to the power source;

a sensor operatively coupled to the control circuitry;

a light source operatively coupled to the control circuitry;

a member formed from one of a transparent material and a translucent material, the member forming a portion of the handle proximate the butt end, the member containing the light source wherein light from the illuminated light source is visible through the member, the member has a generally cylindrical shape and is hollow, the light from the light source is visible over the entire periphery of the member when the light source is illuminated;

wherein the sensor is adapted to detect an impact of the pool cue with another object, and wherein upon detection of the impact, the sensor generates an electrical signal to the control circuitry, causing the control circuitry to illuminate the light source.

2. The light up pool cue of claim 1 wherein the control circuitry causes illumination of the light source for a predetermined period of time after detection of the impact.

3. The light up pool cue of claim 1 whereby the light source is at least one light emitting diode.

4. The light up pool cue of claim 1 wherein the member material is colored.

5. The light up pool cue of claim 1 wherein the member includes a cavity with fluid sealed within the cavity.

6. The light up pool cue of claim 5 whereby the fluid has a viscosity at temperature within the range of 500 centipoise to 5000 centipoise.

7. The light up pool cue of claim 5 whereby the fluid is colored.

8. The light up pool cue of claim 5 further comprising at least one decorative element sealed within the cavity the decorative element being movable within the fluid.

9. The light up pool cue of claim 1 wherein the light source is an entertaing light source for providing visual entertainment value to a user.

10. The light up pool cue of claim 1 wherein the light source one of blinks on and off for a predetermined period of time and illuminates in some other predetermined pattern upon receiving a signal from the control circuitry.

11. The light up pool cue of claim 1 wherein the member is removably mounted between a portion of the handle and an end cap.

12. A light up pool cue having a shaft and a handle with a butt end, comprising:

a power source;

control circuitry operatively coupled to the power source;

a sensor operatively coupled to the control circuitry;

a light source operatively coupled to the control circuitry;

a member formed from one of a transparent material and a translucent material, the member forming a portion of the handle proximate the butt end, the member containing the light source wherein light from the illuminated light source is visible through the member, the member includes an open-ended cavity, a flash unit being removably positionable within the open-ended cavity;

wherein the sensor is adapted to detect an impact of the pool cue with another object, and wherein upon detection of the impact, the sensor generates an electrical signal to the control circuitry, causing the control circuitry to illuminate the light source.

13. The light up pool cue of claim 12 wherein the flash unit comprises a housing member with the sensor, power source and light source mounted thereon.

14. The light up pool cue of claim 13 wherein the member includes a cavity filled with fluid, the fluid being sealed within the cavity, the flash unit being secured within the open-ended cavity by an end cap such that the light source is in visual communication with the fluid.

* * * * *